US008394043B2

(12) United States Patent
Deshpande et al.

(10) Patent No.: US 8,394,043 B2
(45) Date of Patent: Mar. 12, 2013

(54) COMPRESSION GARMENT ASSEMBLY

(75) Inventors: Manish Deshpande, Canton, MA (US); Ross Kanter, Wrentham, MA (US)

(73) Assignee: Covidien LP, Mansfield, MA (US)

( * ) Notice: Subject to any disclaimer, the term of this patent is extended or adjusted under 35 U.S.C. 154(b) by 472 days.

(21) Appl. No.: 12/705,290

(22) Filed: Feb. 12, 2010

(65) Prior Publication Data

US 2011/0201981 A1 Aug. 18, 2011

(51) Int. Cl.
*A61H 7/00* (2006.01)

(52) U.S. Cl. ..... 601/150; 601/151

(58) Field of Classification Search ..... 601/148–152
See application file for complete search history.

(56) References Cited

U.S. PATENT DOCUMENTS

| | | | |
|---|---|---|---|
| 1,928,992 | A | 10/1933 | Clark et al. |
| 3,288,132 | A | 11/1966 | Meredith |
| 3,699,945 | A | 10/1972 | Hanafin |
| 3,826,249 | A | 7/1974 | Lee et al. |
| 4,091,804 | A | 5/1978 | Hasty |
| 4,372,297 | A | 2/1983 | Perlin |
| D269,905 | S | 7/1983 | Tamm |
| 4,402,312 | A | 9/1983 | Villari et al. |
| 4,524,458 | A | 6/1985 | Pongrass et al. |
| 4,579,555 | A | 4/1986 | Russo |
| 4,702,235 | A | 10/1987 | Hong |
| 4,804,208 | A | 2/1989 | Dye |
| 5,135,469 | A | 8/1992 | Castillo |
| 5,152,302 | A | 10/1992 | Fareed |
| 5,310,400 | A | 5/1994 | Rogers et al. |
| 5,312,431 | A | 5/1994 | McEwen |
| 5,342,285 | A | 8/1994 | Dye |
| 5,403,265 | A | 4/1995 | Berguer et al. |
| 5,437,615 | A | 8/1995 | Pekar et al. |
| 5,478,119 | A | 12/1995 | Dye |
| 5,546,955 | A | 8/1996 | Wilk |
| 5,578,055 | A | 11/1996 | McEwen |
| 5,588,954 | A | 12/1996 | Ribando et al. |
| 5,621,514 | A | 4/1997 | Paranto et al. |
| 5,626,556 | A | 5/1997 | Tobler et al. |
| 5,749,493 | A | 5/1998 | Boone et al. |
| 5,795,312 | A | 8/1998 | Dye |
| 5,827,243 | A | 10/1998 | Palestrant |
| 5,891,065 | A | 4/1999 | Cariapa et al. |
| 6,080,120 | A | 6/2000 | Sandman et al. |
| 6,155,263 | A | 12/2000 | Weaver |
| 6,203,510 | B1 | 3/2001 | Takeuchi et al. |
| 6,290,662 | B1 | 9/2001 | Morris et al. |
| 6,319,215 | B1 | 11/2001 | Manor et al. |

(Continued)

FOREIGN PATENT DOCUMENTS

| | | | |
|---|---|---|---|
| WO | 2007085828 | A1 | 8/2007 |
| WO | 2008055304 | A1 | 5/2008 |

(Continued)

*Primary Examiner* — Theodore Stigell
(74) *Attorney, Agent, or Firm* — John Paul Mello, Esq.

(57) ABSTRACT

A compression garment assembly comprises a compression garment adapted for placement on a body part in a self-retaining configuration and for removal from the body part. The compression garment has at least one inflatable bladder for applying compression to the body part. A portable controller unit is adapted for fluid connection to the inflatable bladder and is configured for cyclically inflating the bladder. The compression garment and portable controller unit are configured so that the portable controller unit must be disconnected from the compression garment before the compression garment can be removed from the body part. Loss of the portable controller unit by, for example, accidental disposal with the compression garment is thus prevented.

15 Claims, 8 Drawing Sheets

U.S. PATENT DOCUMENTS 6,375,633 B1 4/2002 Endress et al.
6,428,492 B2 8/2002 Lloyd
6,494,852 B1 12/2002 Barak et al.
6,554,785 B1 4/2003 Sroufe et al.
6,579,252 B2 6/2003 Lloyd et al.
6,589,194 B1 7/2003 Calderon et al.
6,645,165 B2 11/2003 Waldridge et al.
6,676,614 B1 1/2004 Hansen et al.
6,685,661 B2 2/2004 Peled
6,990,700 B2 1/2006 Chung
7,127,762 B1 10/2006 Lau
7,186,245 B1 3/2007 Cheng et al.
7,270,642 B2 9/2007 Ouchene et al.
7,284,291 B2 10/2007 Wang
7,316,658 B2 1/2008 Gagne
7,354,411 B2 4/2008 Perry et al.
7,376,994 B2 5/2008 Wu
7,384,425 B2 6/2008 McEwen
7,442,175 B2 10/2008 Meyer et al.
7,490,620 B2 2/2009 Tesluk et al.
7,641,623 B2 1/2010 Biondo et al.
7,655,049 B2 2/2010 Phillips
2002/0115949 A1 8/2002 Kuslich et al.
2003/0078674 A1 4/2003 Phillips
2004/0199090 A1 10/2004 Sanders et al.
2005/0187503 A1 8/2005 Tordella et al.
2006/0287621 A1 12/2006 Atkinson et al.
2007/0038167 A1 2/2007 Tabron et al.
2007/0049852 A1 3/2007 Linnane et al.
2007/0049853 A1 3/2007 Adams et al.
2007/0055188 A1 3/2007 Avni et al.
2007/0088239 A1 4/2007 Roth et al.
2007/0135743 A1 6/2007 Meyer
2007/0249976 A1 10/2007 Tucker et al.
2007/0249977 A1 10/2007 Bonnefin et al.
2008/0177159 A1 7/2008 Gavriely
2010/0081974 A1 4/2010 Vess
2010/0081977 A1 4/2010 Vess

FOREIGN PATENT DOCUMENTS

Wo 2008084225 A1 7/2008

COMPRESSION GARMENT ASSEMBLY

FIELD OF THE INVENTION

The present invention generally relates to a compression garment assembly, and more particularly to a compression garment assembly configured for loss prevention of a portable controller unit used with a compression garment.

BACKGROUND OF THE INVENTION

A major concern for immobile patients and like persons are medical conditions that form clots in the blood, such as, deep vein thrombosis (DVT) and peripheral edema. Such patients and persons include those undergoing surgery, anesthesia, extended periods of bed rest, etc. These blood clotting conditions generally occur in the deep veins of the lower extremities and/or pelvis. These veins, such as the iliac, femoral, popliteal and tibial return, deoxygenated blood to the heart. For example, when blood circulation in these veins is retarded due to illness, injury or inactivity, there is a tendency for blood to accumulate or pool. A static pool of blood may lead to the formation of a blood clot. A major risk associated with this condition is interference with cardiovascular circulation. Most seriously, a fragment of the blood clot can break loose and migrate. A pulmonary emboli can form from the fragment potentially blocking a main pulmonary artery, which may be life threatening. The current invention can also be applied to the treatment of other conditions, such as lymphedema.

Conventional vascular compression systems include a compression garment fluidly connected to a controller for cyclically inflating the compression garment. The cyclical inflation of the compression garment enhances blood circulation and decreases the likelihood of DVT. Controllers have traditionally been relatively large and are stationed, e.g., at a patient's bedside. A system of conduits connects the compression garment to the controller. Thus, the patient is tethered to the controller. Newer vascular compression garments have portable controllers that are much smaller and even mountable on the compression garment so that the patient may move about freely without having to first remove the compression garment or disconnect the compression garment from the controller. These new compression garments may be worn when a patient is stationary or ambulatory and enhance patient compliance because of convenience of use.

SUMMARY OF THE INVENTION

One aspect of the present invention is directed to a compression garment assembly comprising a compression garment. The compression garment is adapted for placement on a body part in a self-retaining configuration and for removal from the body part. The compression garment has at least one inflatable bladder for applying compression to the body part. A portable controller unit adapted for fluid connection to the inflatable bladder is configured for cyclically inflating the bladder. The compression garment and portable controller unit are configured so that the portable controller unit must be disconnected from the compression garment before the compression garment can be readily removed from the body part.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
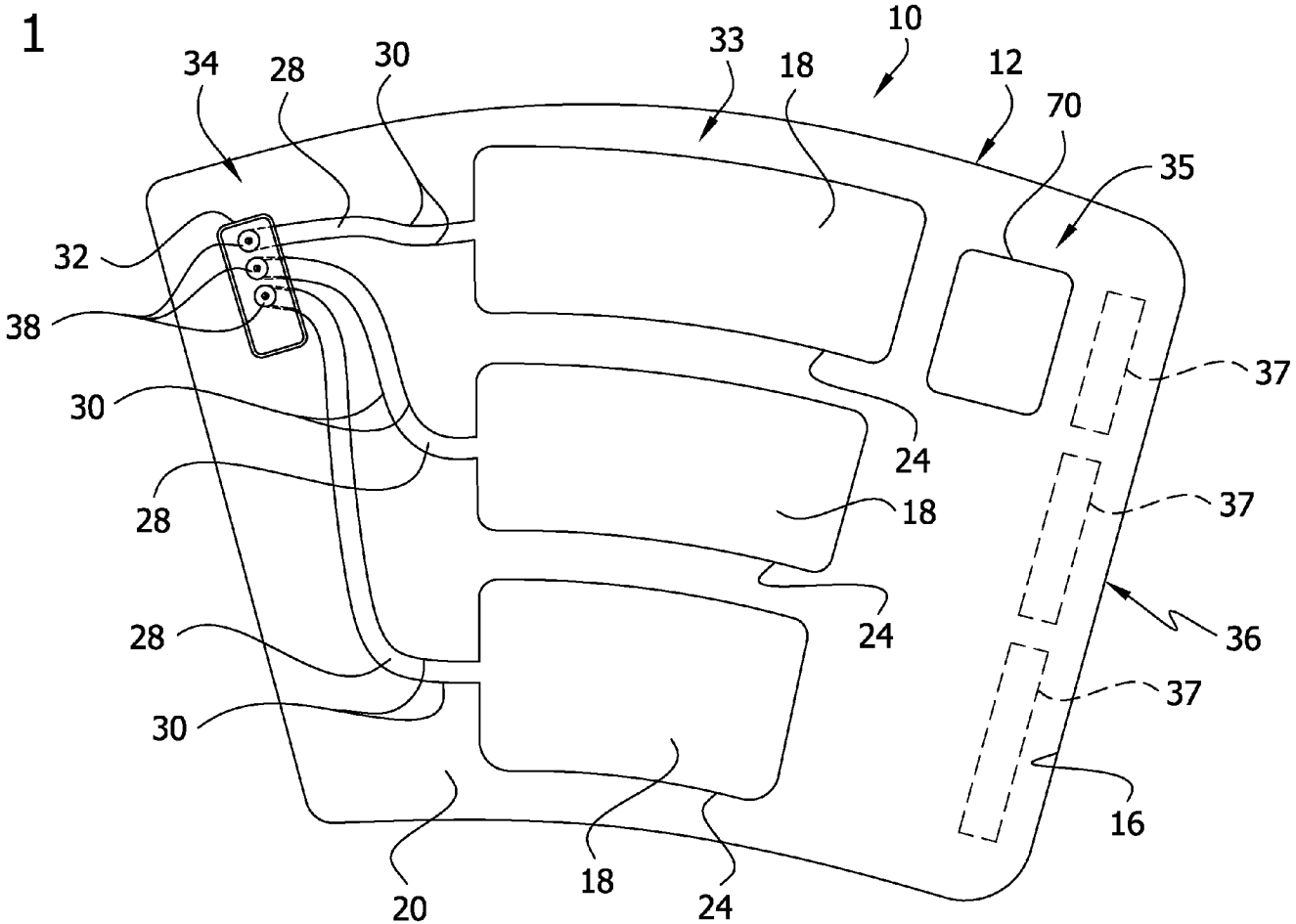
FIG. 1 a plan view of a compression garment of the present invention, the compression garment being in an open, unwrapped configuration.
Figure 2:
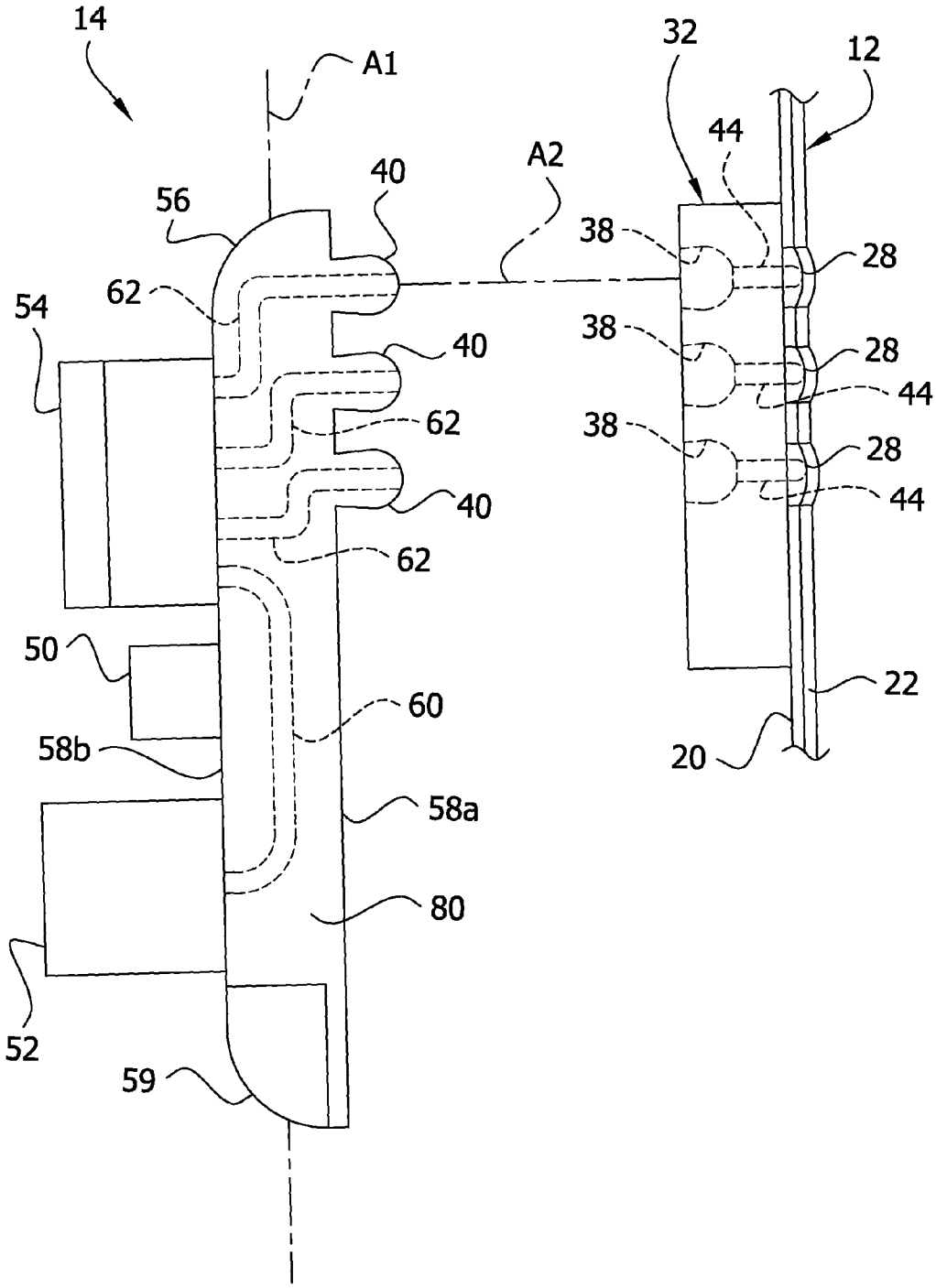
FIG. 2 is an enlarged side elevation of a portable controller unit exploded from a mount.
Figure 3:
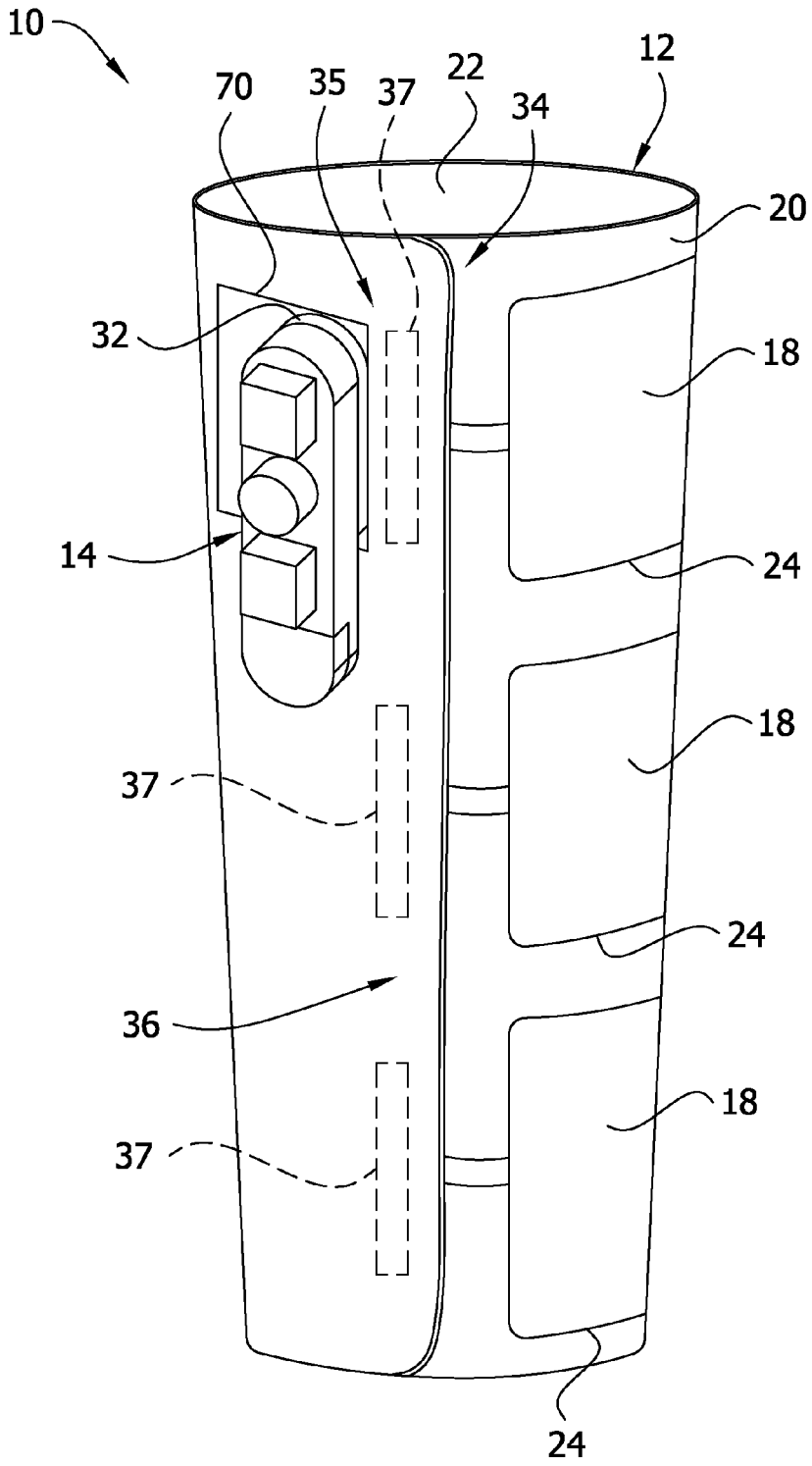
FIG. 3 a perspective of a compression garment assembly including the compression garment of FIG. 1 and the portable controller unit of FIG. 2, the compression garment being in a closed, wrapped configuration.

Referring now to the drawings and in particular to FIGS. 1-3, a compression garment assembly for applying compression therapy to a body part (e.g., a leg) of a wearer is generally indicated 10. The compression garment assembly 10 includes a compression garment, generally indicated 12, and a portable controller unit, generally indicated 14, for cyclically inflating the compression garment. The compression garment 12 may be disposable (e.g., single-use or multiple use with a single patient), and the portable controller unit 14 is made to be reusable with different compression garments.

The compression garment 12 comprises three spaced apart inflatable bladders 18. The number and/or configuration of bladders may be other than shown in the illustrated embodiment. The compression garment 12 comprises opposing outer and inner bladder layers 20, 22, respectively, secured to one another along upper, intermediate and lower bladder sealing lines 24. As used herein, the terms "inner" and "outer" refer to relative positions with respect to the wearer's leg when the garment 12 is wrapped around the leg. The sealing lines 24 together with portions of the bladder layers 20, 22 within the perimeters of the lines define respective inflatable bladders 18 that are capable of retaining pressurized air. Each bladder layer 20, 22 may be integrally formed as a single sheet of material. For example, each bladder layer 20, 22 may be formed from a single sheet of air impermeable material, such as PVC, or may be a laminated material. The bladder layers 20, 22 may be welded to one another along the bladder sealing lines 24, although other ways of forming the bladder lines and the inflatable bladders 18 are within the scope of the invention. Although not illustrated, the compression garment 12 may include an inner layer or liner for contacting the skin of the wearer and an outer layer forming the exterior surface of the garment. Other configurations are within the scope of the present invention.

Referring to FIG. 1, conduits 28 are in fluid communication with the respective inflatable bladders 18 and extend from the inflatable bladders to a mount 32 (broadly, "a conduit terminal") on which the portable controller unit 14 (or "air compressor unit") is mounted. The conduits and several other features of the illustrated compression garment are described in more detail in U.S. patent application Ser. No. 12/241,670 (Vess) and U.S. patent application Ser. No. 12/241,936 (Vess), which are both assigned to Tyco Healthcare Group LP and hereby incorporated by reference in their entireties.

The compression garment 12 is adapted for placement on a body part in a self-retaining configuration and for removal from the body part. The compression garment 12 of the illustrated embodiment is sized and shaped to be wrapped around a leg of a wearer in a closed, wrapped (self-retaining) configuration. The compression garment 12 has a central region 33, a first side edge margin 34, and a second side edge margin 35. The compression garment 12 is placed on the body part by wrapping the compression garment around the body part so that the second edge margin 35 overlaps the first edge margin 34. The compression garment 12 has an attachment portion 36 for securing the compression garment around the body part. In the illustrated embodiment, the attachment portion 36 is the second edge margin 35. Fasteners 37 are provided on an inner surface of the second edge margin 35 for securing the compression garment 12 in the self-retaining configuration on the body part. For example, the fasteners 37 may be hook fabric which is formed for releasable connection with loop fabric on an outer surface of the compression garment 12 (e.g., loop fabric laminated to the outside surface of the compression garment).

Referring to FIGS. 1 and 2, the mount 32 is secured to an exterior surface of the outer bladder layer 20 on the first edge margin 34 of the compression garment 12. The mount 32 includes internal female connector components 38 for receiving mateable male connector components 40 of the portable controller unit 14 to releasably mount the controller unit on the compression garment 12. It is understood that the mount 32 may include male connection components for being received in mateable female connector components of the portable controller unit 14 within the scope of the invention. In the illustrated embodiment, the male connection components 40 are releasably retained in the female connection components 38 by snap-fit engagement. The male connector components 40 have a slightly bulbous shape and the female connector components 38 ("receptacles") have a corresponding shape. The widest part of the male connector component 40 is wider than a mouth of the female connector component 38 so that the male component and/or female component are deformed as the male component enters the female connector component. Once the male connector component 40 is inserted far enough into the female connector component 38, it reaches a wider portion of the female connector component and "snaps" back toward its original shape. It will be appreciated that the connector components 38, 40 thereafter resist separation. However, upon application of sufficient force, the connector components 38, 40 can be disconnected. Other ways of releasably mounting the portable controller unit 14 on the compression garment 12 are within the scope of the invention.

Referring to FIG. 2, each female connector component 38 of the mount 32 is fluidly connected to one of the conduits 28 via an inlet passage 44 inside the mount. In one example, the mount 32, including the female connector components 38 and the inlet passages 44, is molded as a one-piece unit. Other ways of forming the mount 32 are within the scope of the invention. For example, structure for supporting the portable controller unit 14 on the garment 12 can be separate from the structure for making fluid connection with the bladders 18. The mount 32 is secured to the outer and inner bladder layers 20, 22 by heat welding (e.g., radiofrequency (RF) welding), adhesive, mechanical connectors or in other ways so that the inlet passages 44 in the mount are in sealed, fluid communication with the respective bladder conduits 28.

Referring to FIGS. 2 and 3, the portable controller unit 14 includes a controller 50 electrically connected to an air compressor 52 and a valve mechanism 54. Each of the components 50, 52, 54 is mounted on a manifold base 56 (broadly, a base). As explained below, the male connection components 40 extend outward from the manifold base 56. More specifically, the male connection components 40 extend outward from a first face 58a (FIG. 2) of the base 56 and the controller 50, air compressor 52 and valve mechanism 54 are mounted on an opposite second face 58b (FIG. 2) of the base. In the illustrated embodiment, a longitudinal axis A1 of the base 56 is generally orthogonal to axes A2 (only one is illustrated) of the connection components 40. The controller 50 may be a microprocessor that communicates with the air compressor 52 and the valve mechanism 54 during operation. The valve mechanism 54 may comprise a plurality of valves (e.g., solenoid valves) that are controlled by the microprocessor. The controller unit 14 includes a rechargeable, portable power source, such as a battery 59 for supplying power to the controller 50, the air compressor, 52 and the valve mechanism 54. The operation of the portable controller unit 14 may operate generally in the same manner as taught in the art.

Referring to FIG. 2, the manifold base 56 includes a single internal inlet plenum 60 and a plurality of internal outlet plenums 62 extending through the male connector components 40. The inlet plenum 60 fluidly connects the air compressor 52 and the valve mechanism 54. The inlet plenum 60 extends from the second face 58*b* of the manifold base 56 at a first location to a second location on the second face. The air compressor 52 is mounted on the second face 58*b* of the base 56 in fluid communication with the inlet plenum 60 at the first location. The outlet plenums 62 fluidly connect the valve mechanism 54 and the male connector components 40. The outlet plenums 62 extend through the second face 58*b* of the base 56 at third location and extend axially through the male connector components 40 to fluidly connect the valve mechanism 54 to the respective conduits 28 and the respective bladders 18. The valve mechanism 54 is mounted on the second face 58*b* of the base 56 in fluid communication with both the inlet plenum 62 at the second location and the outlet plenums 62 at the third locations. In one example, the manifold base 56, including the inlet plenum 60, the outlet plenums 62 and the male connector components 40, is molded as a single, integral unit. For example, the base 56 and the male components 40 may be formed from a resilient polymeric material.

It is understood that portable controller units having other configurations are within the scope of the present invention. For example, the base 56 may be formed in other ways without departing from the scope of the present invention. Moreover, the portable controller unit 14 may have alternate fluidic and mounting connections with the compression garment 12. As described in an additional embodiment below, the fluid connection of the portable controller unit 14 with the compression garment 12 may be separate from the connection that serves to mount the portable controller unit on the compression garment. The portable controller unit 14 may also include a cover (not shown) detachably secured to the manifold base 56 to enclose the controller 50, the air compressor 52 and/or the valve mechanism 54. In some embodiments, the portable controller unit 14 has a low center of gravity to improve the mechanical stability of the controller.

The compression garment 12 and the portable controller unit 14 are configured to prevent loss of the portable controller unit. As mentioned above, the compression garment 12 may be disposable (e.g., single-use or multiple use with a single patient), and the portable controller unit 14 is reusable with different compression garments. Thus, it is desirable to prevent loss of the portable controller unit 14. To prevent loss of the portable controller unit 14, the compression garment 12 and the portable controller unit are configured so that the portable controller unit must be disconnected from the compression garment before the compression garment can be readily removed from the body part. It will be understood that contortions of the garment and or controller that might permit the garment to be removed without disconnecting the controller, but which are not readily accomplished (e.g., as in simply unwrapping a wrapped garment) would fall within the scope of the present invention. Thus, the controller unit 14 is "first off" when removing the compression garment assembly 10 from a limb. This configuration increases the possibility that personnel will place the portable controller unit 14 in a location where the portable controller unit will not be lost (e.g., not discarded with the disposable compression garment). In some embodiments, such as the one illustrated in FIGS. 1-3, the compression garment assembly 10 is also configured so the portable controller unit 14 is "last on" when applying the compression garment assembly to a body part. In other words, to properly place the compression garment assembly 10 on a body part, the portable comptroller unit 14 cannot be connected to the compression garment 12 until after the compression garment is placed on the body part.

To make the portable controller unit 14 "first off," the attachment portion 36 of the compression garment 12 is cooperable with the portable controller unit 14 to inhibit disconnection of the attachment portion from the garment prior to disconnection of the portable controller unit from the garment. In the illustrated embodiment, the compression garment 12 has an opening 70 positioned on the compression garment so that the mount 32 is accessible through the opening when the compression garment is wrapped around the body part. More specifically, the opening 70 in the compression garment 12 is located on the second edge margin 35 so that the mount 32 on the first edge margin 34 is accessible through the opening when the compression garment is wrapped around the body part. To make the portable controller unit 14 "last on," the attachment portion 36 of the compression garment 12 is cooperable with the portable controller unit 14 to inhibit proper connection of the attachment portion to the garment when the controller unit is connected to the garment. Accordingly, for the garment 12 and the portable controller unit 14 to be properly installed on a limb, the attachment portion 36 needs to be connected to the garment before the portable controller unit is connected to the compression garment.

The opening 70 is desirably sized so the mount 32 is accessible through the opening (i.e., the male connector components 40 can be received in the female connector components 38) and so that the portable controller unit 14 cannot pass through the opening. As shown in FIGS. 1 and 3, the opening 70 may be elongated along the width of the compression garment 12 to allow the garment to be adjusted circumferentially around limbs for legs of various sizes, while still permitting access through the opening. The opening 70 may have other sizes or shapes or be configured differently to enable adjustment of the garment 12 to comfortably and ergonomically fit limbs or other body parts of various sizes and shapes. When the compression garment 12 is secured around the body part, and the portable controller unit 14 is connected to the mount 32, the portable controller unit overlies the second edge margin 35 of the compression garment such that the compression garment cannot be unwrapped from the body part until after the portable controller unit is disconnected from the mount. Although FIG. 3 shows the portable controller unit 14 overlying only a portion of the second edge margin 35 below the opening 70, the portable controller unit may overlie other or additional portions of the second edge margin such as portions above or to the sides of the opening. For example, the portable controller unit 14 may overlie portions of the second edge margin 35 above and below the opening 70. The attachment portion 36 is inhibited from disconnecting from the compression garment 12 because the portable controller unit 14 overlies the second edge margin 35, preventing the compression garment from being unwrapped from the body part. In some embodiments, the opening 70 may not be absolutely smaller than the portable controller unit 14. However, the opening 70 is desirably sized so that the portable controller unit 14 overlies the second edge margin 35 to inhibit or substantially hinder unwrapping the compression garment 12 from the body part without first removing the portable controller unit from the compression garment.

To further assist in preventing loss of the portable controller unit 14, the portable controller unit may have a high visibility indicator 80 for drawing attention to the portable controller unit. For example, the portable controller unit may have bright colors (e.g., paint or decals), reflective surfaces, and/or lights. More than one and other forms of high visibility indicators may be used.

In an exemplary use, the compression garment 12 is wrapped around a body part, e.g., a leg, of a patient. The hook fasteners 37 are pressed against the outer surface of the compression garment 12 to releasably secure the compression garment to the wearer's leg, as is generally known in the art. After the compression garment 12 is secured to the wearer's limb, the portable controller unit 14 is mounted on the garment 12 by inserting the male connection components 40 into the respective female connection components 38 in the mount 32. As explained above, the male connection components 38 are retained in the female connection components 38 by snap-fit engagement. With the controller unit 14 mounted on the garment 12, the controller unit is in fluid communication with the inflatable bladders 18. The controller 50 can be activated to begin compression therapy, whereby the air compressor 52 delivers pressurized air via the inlet plenum 60 in the manifold base 56 to the valve mechanism 54, which diverts the air into one of the three outlet plenums 62 and into the appropriate bladder 18 via one of the conduits 28. The portable controller unit 14 can be detached from the compression garment 12 by simply pulling the base 56 away from the mount 32 so that the male connection components 40 disengage the female connection components 38 in the mount 32. As explained above, the portable controller unit 14 must be disconnected from the compression garment 12 before the compression garment can be unwrapped from the leg. The portable controller unit 14 may be reused on the same compression garment 12 or on a different compression garment.

Figure 4:
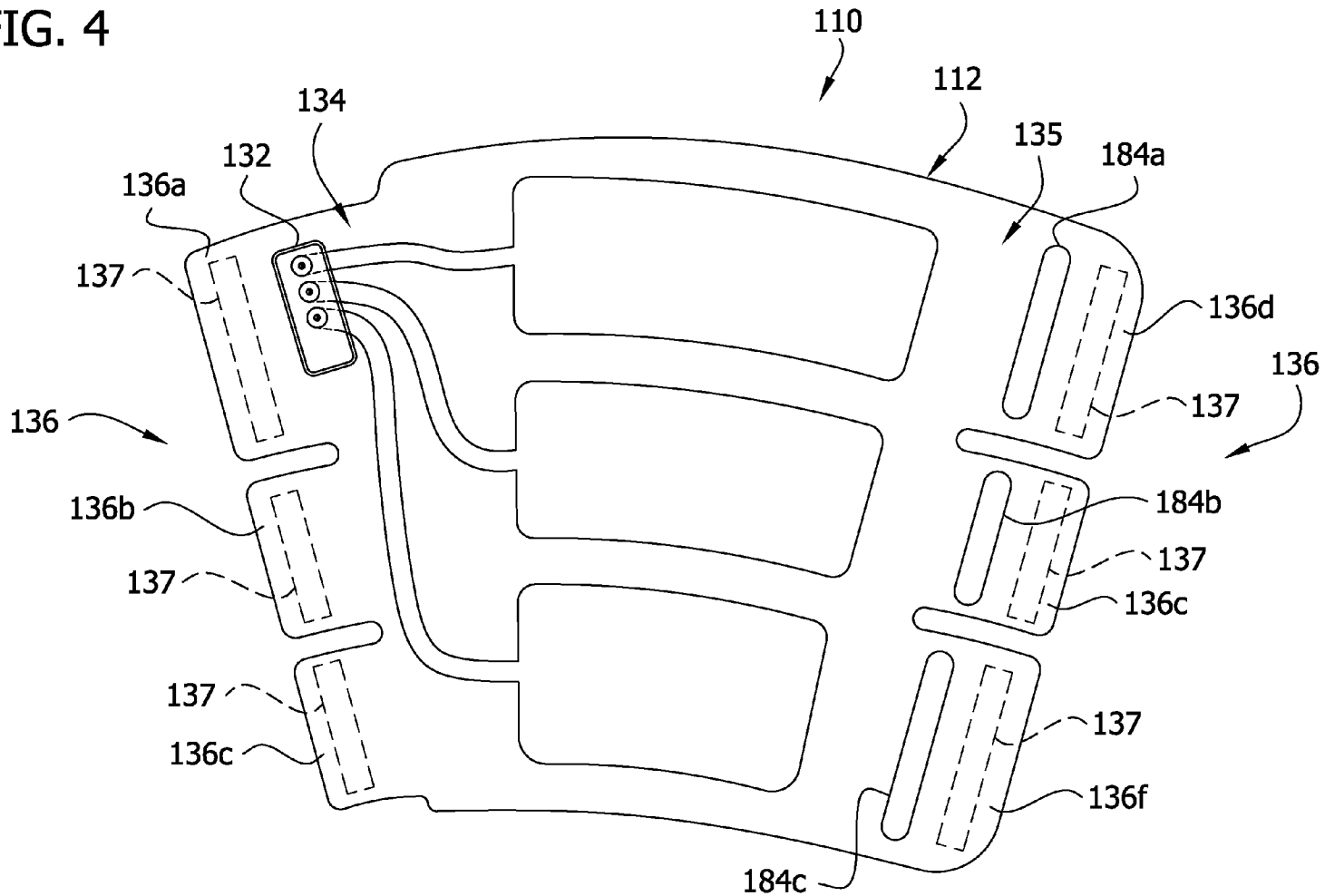
FIG. 4 is a plan view of a second embodiment of a compression garment of the present invention, the compression garment being in an open, unwrapped configuration.
Figure 5:
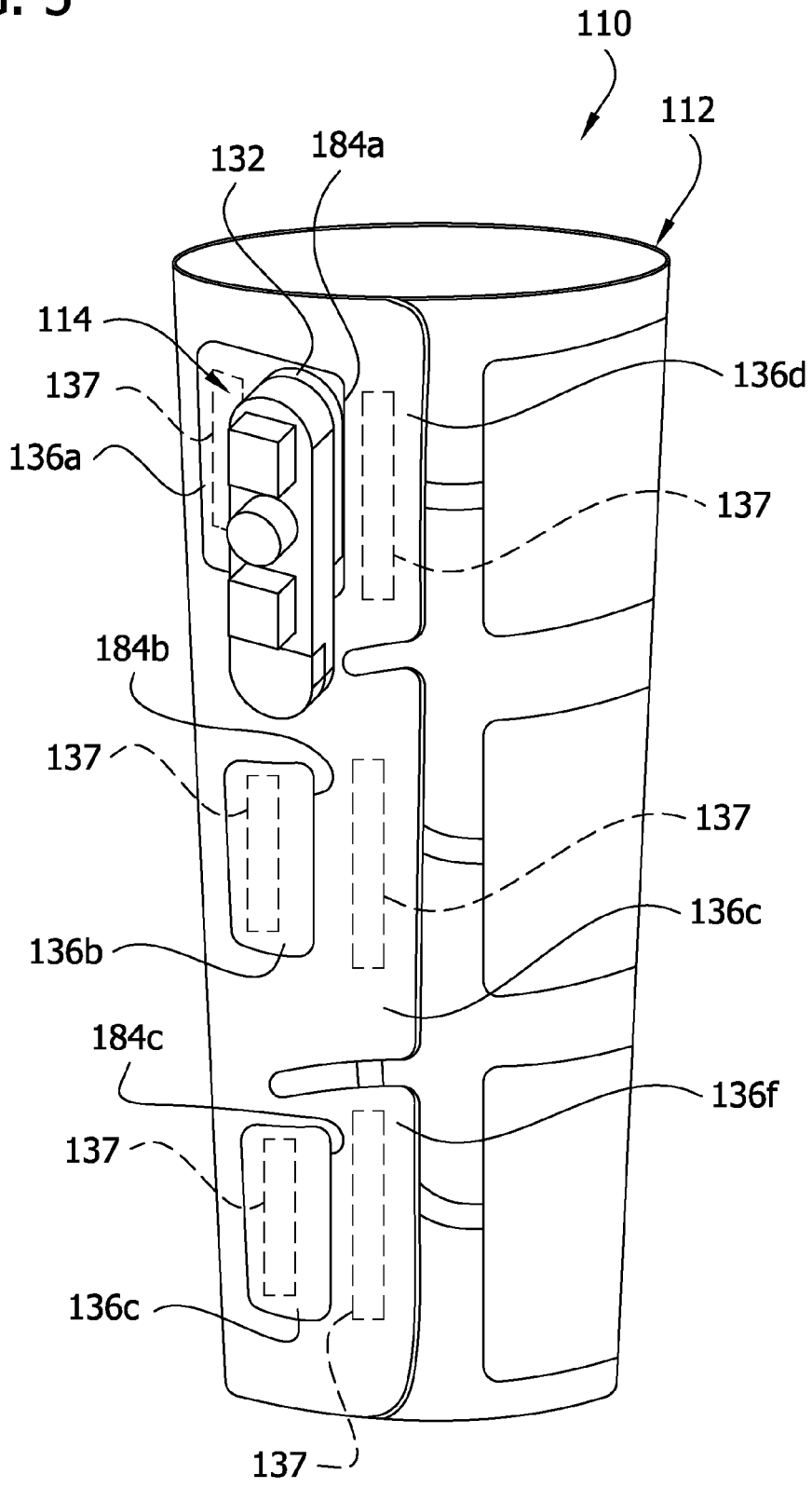
FIG. 5 is a perspective of a compression garment assembly including the compression garment of FIG. 4 and the portable controller unit similar to FIG. 2, the compression garment being in a closed, wrapped configuration.

FIGS. 4 and 5 illustrate a second embodiment of a compression garment assembly 110 of the present invention. The compression garment assembly 110 is similar to the compression garment assembly 10 described above, and corresponding parts are generally indicated by the same reference numbers, plus 100. The portable controller unit 114 is substantially similar to the portable controller unit 14 of the previous embodiment. In this embodiment, the attachment portions 136 of the compression garment are flaps **136*a*-136*f*. Three flaps 136*a*-136*c* are provided on the first edge margin 134, and three flaps 136*d*-136*f* are provided on the second edge margin 135. Three openings 184*a*-184*c* are provided in the second edge margin 135. The openings 184***a*-184*c* are sized so that the flaps 136*a*-136*c* on the first edge margin 134 may be threaded through the openings. The compression garment 112 is placed on a body part by wrapping the compression garment around the body part and threading the flaps 136*a*-136*c* on the first edge margin 134 through the openings 184*a*-184*c*. Fasteners 137 (e.g., hook fabric) are provided on an inner surface of the flaps 136*a*-136*f* for securing the flaps to an outside surface of the compression garment to maintain the compression garment in the self-retaining configuration on the body part (FIG. 5).

In this embodiment, the mount 132 is located on one of the flaps 136*a* so that the portable controller unit 114 must be disconnected from the compression garment 112 before the compression garment can be removed from the body part. The mount 132 is accessible through the opening 184*a* through which the flap 136*a* is threaded. The flap 136*a* and the mount 132 are sized so that the flap and mount can be threaded through the opening 184*a* in the compression garment 112 when the portable controller unit 114 is not connected to the mount. However, the flap 136*a* and mount 132 are incapable of being unthreaded from the opening 184*a* unless the portable controller unit 114 is disconnected from the mount. Desirably, the portable controller unit 114 is sized so the controller unit cannot pass through the opening 184*a* when connected to the mount 132. Thus, the attachment portion 136 is cooperable with the portable controller unit 114 to inhibit disconnection of the attachment portion from the garment 112 prior to disconnection of the portable controller unit from the compression garment.

The compression garment assembly 110 of this embodiment is used in a similar fashion as the embodiment described above. The portable controller 114 is connected to the mount 132 after the compression garment 112 is wrapped around the body part and the flap 136*a* and mount are threaded through the opening 184*a*. Loss of the portable controller unit 114 (e.g., by accidental disposal with the compression garment 112) is prevented because the portable controller unit 114 must be disconnected from the compression garment 112 before the compression garment can be removed from the body part.

Figure 6:
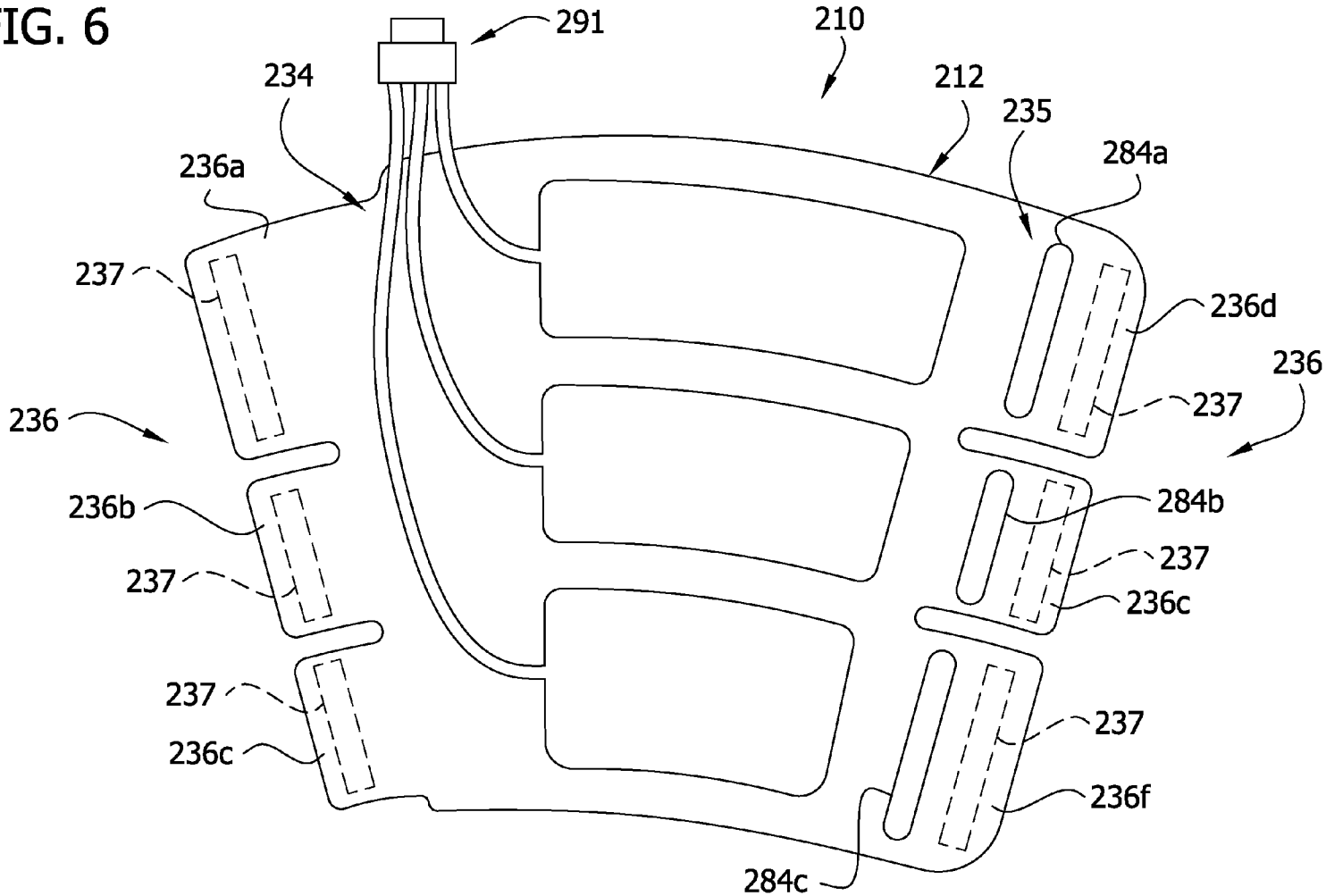
FIG. 6 is a plan view of a third embodiment of a compression garment of the present invention; the compression garment being in an open, unwrapped configuration.
Figure 7:
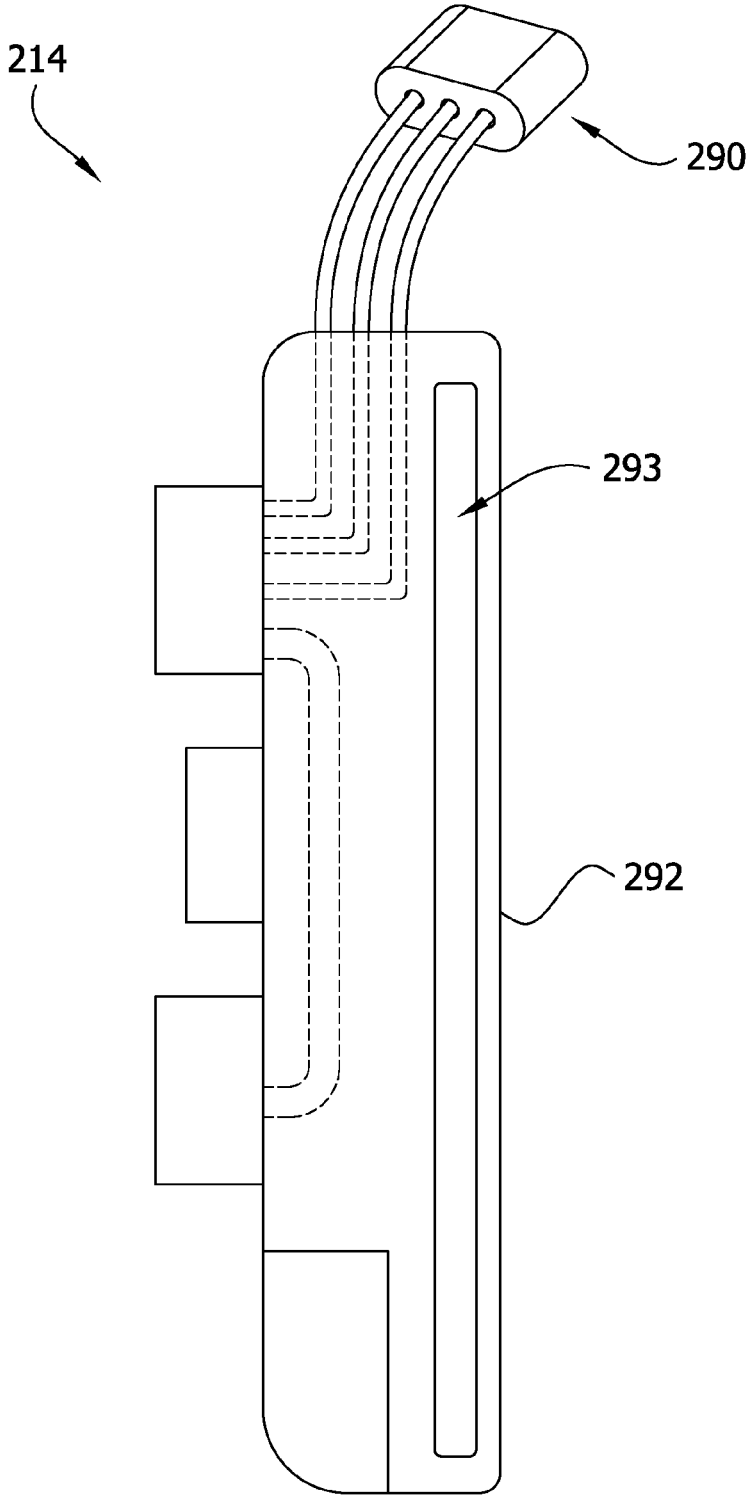
FIG. 7 is an enlarged side elevation of a second embodiment of a portable controller unit.
Figure 8:
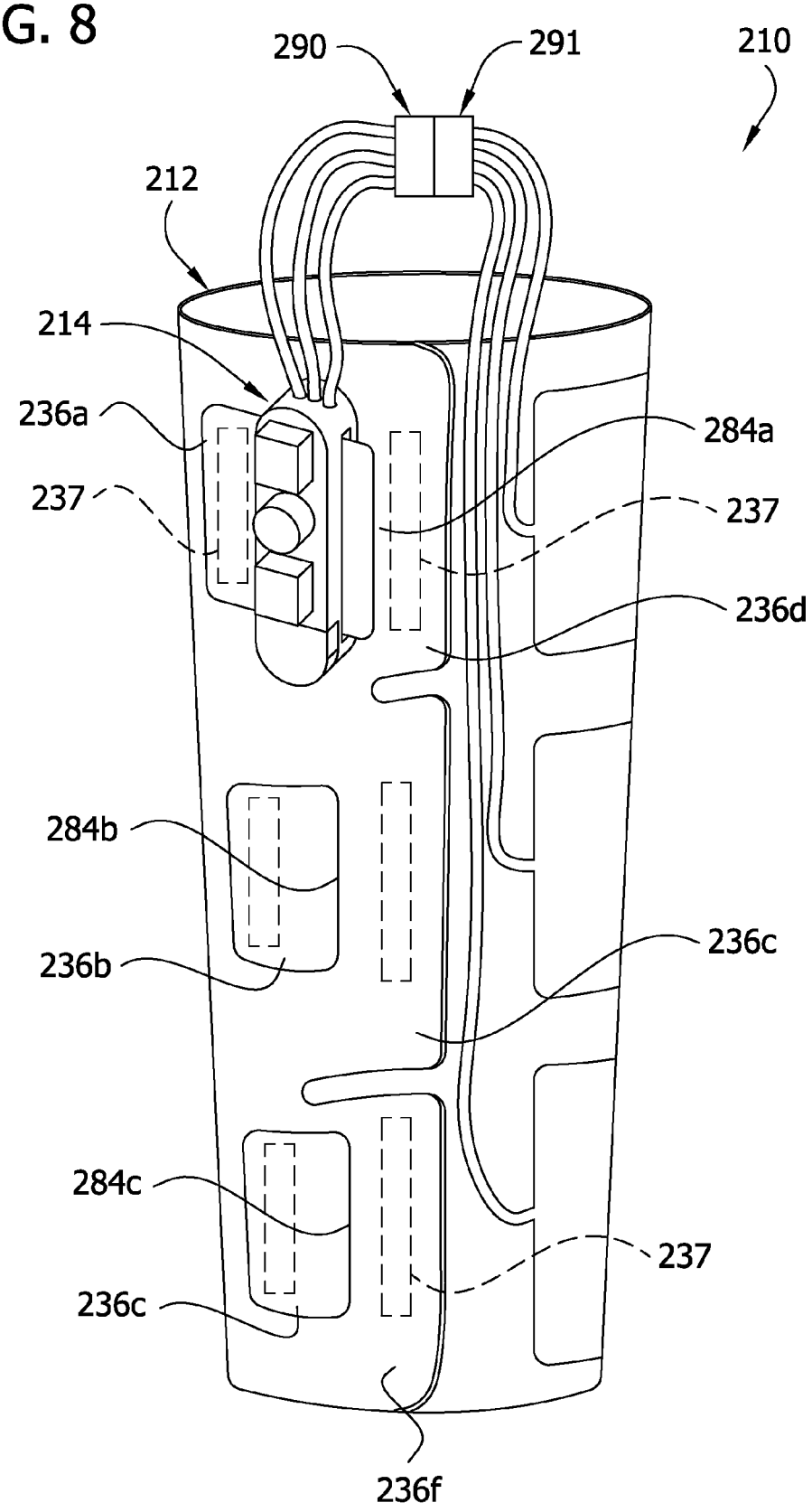
FIG. 8 is a perspective of a compression garment assembly including the compression garment of FIG. 6 and the portable controller unit of FIG. 7, the compression garment being shown in a closed, wrapped configuration.

FIGS. 6, 7, and 8 illustrate a third embodiment of a compression garment assembly 210 of the present invention. The compression garment assembly 210 is similar to the compression garment assembly 110 described above, and corresponding parts are generally indicated by the same reference numbers, plus 100. The compression garment 212 of this embodiment also has attachment portions 236 comprising flaps 236*a*-236*f*. The flaps 236*a*-236*f* are provided on the first and second edge margins 234 and 235. The compression garment 112 is wrapped around the body part, and the flaps 236*a*-236*c* are threaded through the openings 284*a*-284*c* in the second edge margin 235. The fasteners 237 (e.g., hook fabric) are used to secure the compression garment 212 in its self-retaining configuration on the body part.

In this embodiment, the portable controller unit 214 makes a fluidic connection with the compression garment separate from a mounting connection with the compression garment. For making a fluidic connection, the portable controller unit has a fluidic connector assembly 290 configured for mating with a fluidic connector assembly 291 of the compression garment. For mounting the portable controller unit 214 on the compression garment 212, the portable controller unit is provided with a retainer 292 forming a loop 293 with the portable controller unit 214. The portable controller unit 214 is mounted on the compression garment 212 by threading the flap 236*a* through the loop 293 (i.e., between the retainer 292 and the base of the portable controller unit 214). The fastener 237 on the flap 236*a* is then secured to the compression garment 212. The portable controller unit 214 must be disconnected (e.g., unthreaded from the flap 236*a*) before the compression garment 212 can be removed from the body part. Because the portable controller unit 214 must be unthreaded from the flap 236*a*, the attachment portion 236 is cooperable with the portable controller unit 214 to inhibit disconnection of the attachment portion from the compression garment 212 prior to disconnection of the portable controller unit from the compression garment.

The retainer 292 may be formed in other ways (not shown) for mounting on the attachment portion 236 such that the portable controller 214 unit must be disconnected from the compression garment 212 before the compression garment can be removed from the body part. Other configurations may be used that make the attachment portion 236 cooperable with the portable controller unit 214 to inhibit disconnection of the attachment portion from the compression garment 212 prior to disconnection of the portable controller unit. For example, the retainer 292 on the portable controller unit 214 may comprise a clip (not shown) instead of a loop 293 for securing the portable controller unit to the flap 236*a* so that the portable controller unit must be unclipped from the compression garment 212 before the compression garment can be removed from the body part.

The compression garment assembly 210 of this embodiment is used similarly to the embodiments described above. The retainer 292 is used to mount the portable controller unit 214 to the flap 236*a* after the compression garment 212 is wrapped around the body part and the flap is threaded through the opening 284*a*. Loss of the portable controller unit 214 (e.g., by accidental disposal with the compression garment) is prevented because the portable controller unit must be disconnected from the compression garment 212 before the compression garment can be removed from the body part.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A compression garment assembly comprising:

a compression garment adapted for placement on a body part in a self-retaining configuration and for removal from the body part, the compression garment having at least one inflatable bladder for applying compression to the body part;

a portable controller unit selectively connectible to the compression garment and adapted for fluid connection to the inflatable bladder, the portable controller unit being configured for cyclically inflating the bladder;

wherein the compression garment and portable controller unit are configured so that the portable controller unit must be disconnected from the compression garment before the compression garment can be readily removed from the body part.

2. The compression garment assembly of claim 1, wherein the garment comprises an attachment portion releasably connectable to the garment for securing the garment on the body part in said self-retaining configuration, the attachment portion being cooperable with the portable controller unit to inhibit disconnection of the attachment portion from the garment prior to disconnection of the portable controller unit from the garment.

3. The compression garment assembly of claim 2, further comprising a mount on the garment and an opening through the garment, the mount being accessible through the opening.

4. The compression garment assembly of claim 3, wherein the attachment portion comprises a flap, the mount being located on the flap, the flap and mount being sized so that the flap and mount can be threaded through the opening in the compression garment when the portable controller unit is not connected to the mount, and the flap and mount being incapable of unthreading from said opening unless the portable controller unit is disconnected from the mount.

5. The compression garment assembly of claim 4, wherein the portable controller unit is sized so that the portable controller unit cannot pass through the opening in the compression garment when connected to the mount.

6. The compression garment assembly of claim 4, wherein the compression garment comprises first and second edge margins, the compression garment being placed on the body part by wrapping the compression garment around the body part, the flap being part of the first edge margin of the compression garment, and the opening in the compression garment being located on the second edge margin of the compression garment.

7. The compression garment of claim 4, further comprising a fastener located on an inner surface of the flap for securing the flap to an outside surface of the compression garment to maintain the compression garment in said self-retaining configuration on the body part.

8. The compression garment of claim 4, wherein the portable controller unit has a high visibility indicator for drawing attention to the portable controller unit to prevent accidental disposal of the portable controller unit.

9. The compression garment assembly of claim 3, wherein the compression garment comprises first and second edge margins and the compression garment is placed on the body part by wrapping the compression garment around the body part so that the second edge margin overlaps the first edge margin, the opening in the compression garment being positioned on the compression garment so that the mount is accessible through the opening when the compression garment is wrapped around the body part.

10. The compression garment assembly of claim 9, wherein the opening in the compression garment is located on the second edge margin of the compression garment and the mount is located on the first edge margin.

11. The compression garment assembly of claim 9, wherein the portable controller unit is sized so that the portable controller unit cannot pass through the opening in the compression garment when connected to the mount.

12. The compression garment assembly of claim 9, wherein the portable controller unit is sized so that the portable controller unit overlies the second edge margin of the compression garment when the compression garment is placed on the body part and the portable controller unit is connected to the mount on the first edge margin.

13. The compression garment assembly of claim 9, further comprising a fastener located on an inner surface of the second edge margin for securing the flap to an outside surface of the compression garment to maintain the compression garment wrapped around the body part.

14. The compression garment assembly of claim 2, wherein the portable controller unit comprises a compressor for generating pressurized air, a valve for selectively allowing and blocking flow of pressurized air from the portable controller unit to the compression garment, and a controller for controlling flow of pressurized air from the portable controller unit to the compression garment.

15. The compression garment assembly of claim 2, wherein the compression garment comprises a plurality of inflatable bladders.

* * * * *